US006474278B1

(12) United States Patent
Davis et al.

(10) Patent No.: US 6,474,278 B1
(45) Date of Patent: Nov. 5, 2002

(54) GLOBAL CAM SENSING SYSTEM

(75) Inventors: Jason Thomas Davis, Williamston; Donald Clayton Warner, Byron; David Stewart Mathews, Howell, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/716,836

(22) Filed: Nov. 20, 2000

(51) Int. Cl.[7] ..... F01L 1/34

(52) U.S. Cl. ..... 123/90.15; 123/90.17; 123/90.18; 324/173

(58) Field of Search ..... 123/90.15, 90.16, 123/90.17, 90.18, 90.31; 73/116, 117.2, 117.3, 118.1; 324/207.25, 173, 174

(56) References Cited

U.S. PATENT DOCUMENTS 5,209,202 A 5/1993 Maurer et al. ..... 123/414
5,548,995 A 8/1996 Clinton et al. ..... 73/116
5,559,705 A * 9/1996 McClish ..... 364/431.07
5,577,475 A 11/1996 De Backer et al. ..... 123/417
5,717,133 A * 2/1998 Wu ..... 73/116
5,918,577 A * 7/1999 Martelli ..... 123/295
5,979,413 A * 11/1999 Ohnuma ..... 123/491

* cited by examiner

*Primary Examiner*—Thomas Denion
*Assistant Examiner*—Jaime Corrigan
(74) *Attorney, Agent, or Firm*—Christopher DeVries

(57) ABSTRACT

A camshaft system for use with an internal combustion engine including a camshaft having a plurality of lobes to actuate valves in the internal combustion engine, a sprocket coupled to the camshaft to drive the camshaft, and a target wheel coupled to the camshaft, the target wheel having an irregular surface capable of providing process data for operation of a plurality of internal combustion engine configurations.

24 Claims, 6 Drawing Sheets

| FIG. 4A | FIG. 4B | FIG. 4C |
|---|---|---|

GLOBAL CAM SENSING SYSTEM

TECHNICAL FIELD

The present invention relates to the control of an internal combustion engine. More specifically, the present invention relates to a global cam sensing system that may be integrated seamlessly with multiple internal combustion engines having a plurality of cylinder configurations.

BACKGROUND OF THE INVENTION

Integration of vehicle parts, electronic components, and software into automotive vehicles is becoming increasingly important in today's automotive industry. Traditional methods of vehicle assembly for vehicle parts and components is giving way to flexible modular design and manufacturing techniques.

Presently, automotive companies manufacture a wide range of internal combustion engine (ICE) configurations such as in-line four-cylinder engines, in-line five-cylinder engines, in-line six-cylinder engines, and V-eight engines. As is known in the art of four-cycle ICEs, position and timing between a crankshaft and a camshaft is very important for the application and synchronization of spark and fuel, as the camshaft actuates the intake and exhaust valves of an ICE. A camshaft may be used in an overhead valve (OHV) configuration where the valves are actuated via pushrods, or in an overhead cam (OHC) configuration where the valves are acted on directly by the camshaft. The camshaft is driven by the crankshaft through a 1:2 reduction (i.e., two rotations of the crankshaft equal one rotation of the camshaft) and the camshaft speed is one-half that of the crankshaft. The crankshaft and camshaft position, for engine control purposes, are measured at a small number of fixed points, and the number of such measurements may be determined by the number of cylinders in the ICE.

In today's engine control systems, crankshaft speed supplied by a crankshaft sensor provides position, timing, and/or speed information to an electronic controller for controlling the application of spark and fuel to the cylinders of an ICE. The position and timing (phase) of a first camshaft controlling exhaust valves for a cylinder and/or a second camshaft controlling intake valves for a cylinder in an overhead cam engine may be controlled relative to the crankshaft (piston position) to reduce emissions and improve fuel economy. Several cam-phasing devices exist in today's automotive market that require accurate position and timing information provided by a camshaft position sensor. The camshaft position sensor typically includes a variable reluctance or Hall effect sensor positioned to sense the passage of a tooth, tab, and/or slot on a target or data wheel coupled to the camshaft.

The target wheel or data wheel used in present camshaft position sensors has a generally regular distribution of teeth, tabs, and/or slots. In a four cycle ICE, the electronic controller must further differentiate the intake, compression, power, and exhaust strokes since the cylinders will be at the top dead center (TDC) position during the compression and exhaust phases and at the bottom dead center (BDC) position during the intake and power phases. Accordingly, the application of fuel and spark in a typical ICE will not be applied until enough position information has been obtained from the crank or cam sensing systems. Thus, the engine controller must not only determine the TDC and BDC positions of the cylinder but also the state of the engine cycle to control fuel and spark.

Target or data wheels for a camshaft that provide camshaft position may either be common across all engine configurations (i.e., the number of cylinders) or specific for each engine configuration. Target wheels that are designed to be specific to the number of cylinders in the engine provide the optimum data for functions such as control of a camshaft phaser or delivery of fuel/spark in the event of a failure of the crank sensor circuit. These present systems have the disadvantages of requiring different hardware and software for each engine configuration. Target wheels that are common across all engine configurations may provide the advantage of faster engine position information, but lack enough position information for optimum control of a cam phaser and delivery of fuel/spark in the event of a failure of the crankshaft sensor system. It would be advantageous for an automotive company to utilize a single type of generic camshaft sensing system with a single generic target wheel and calibratible software that can be used on a plurality of engine configurations, while still providing for control of cam phasers, and delivery of fuel/spark in the event of a failure of the crank sensor system, and providing the fastest engine position information.

SUMMARY OF THE INVENTION

The present invention comprises a new camshaft sensing system common to four cycle internal combustion engines (ICEs), including but not limited to four, five, six, and eight cylinder engines. The cam system, and specifically the sensor and target wheel, provide an output signal with "events" at a fixed location relative to top dead center (TDC) compression for cylinders of the engine configurations listed above. This is achieved with the minimum number of sensing features possible to reduce the cost, complexity, and control system throughput of the camshaft sensing system, while maximizing functionality and providing quick engine synchronization.

The present invention utilizes an 8×+s cam with eight binary (state encoded) base periods for engine cam timing functions. Each semi-period or state is bounded by a rising and falling edge that are a fixed angle before TDC for one or more cylinders of all four, five, six, and eight cylinder engine configurations. In the present invention, the edge that corresponds to TDC for cylinder one is common to all engine configurations. In addition to the base periods for engine timing functions, an additional state is added to the system at a location known as the synchronization region or pulse. This state and its bounding edges are used purely to synchronize the engine quickly when the crank position has been determined. The common camshaft sensing system of the present invention can be used on a plurality of engine types with no loss of functionality, as compared to cylinder number specific cam systems or 1× cam system of the prior art.

The 8×+s cam sensing system of the present invention places an edge (electrical signal) at a consistent location prior to TDC for all four, five, six and eight cylinder engine configurations. Through programming and calibration, each engine controller selects which edge numbers it will use for specific cam tasks. These will generally be those edges that fall at a consistent angle prior to TDC for the specific engine configuration. In addition, all engines will use the ½ period known as the sync pulse, and the corresponding opposite state of the cam signal 360 crank degrees later to achieve the full engine sync as quickly as possible. The combination of these properties is unique to this cam sensing system and provides the ability to do all known cam tasks with the highest degree of accuracy using a single common cam system.

The camshaft sensing system of the present invention provides cost, assembly, and integration benefits, as compared to existing cylinder specific cam systems. In addition, the camshaft sensing system of the present invention provides increased functionality over existing systems by providing engine cycle position and timing, cylinder event based cam control (for cam phaser applications), and a backup speed and position signal for spark and fuel control in the event of a failure of the crankshaft sensor.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 1:
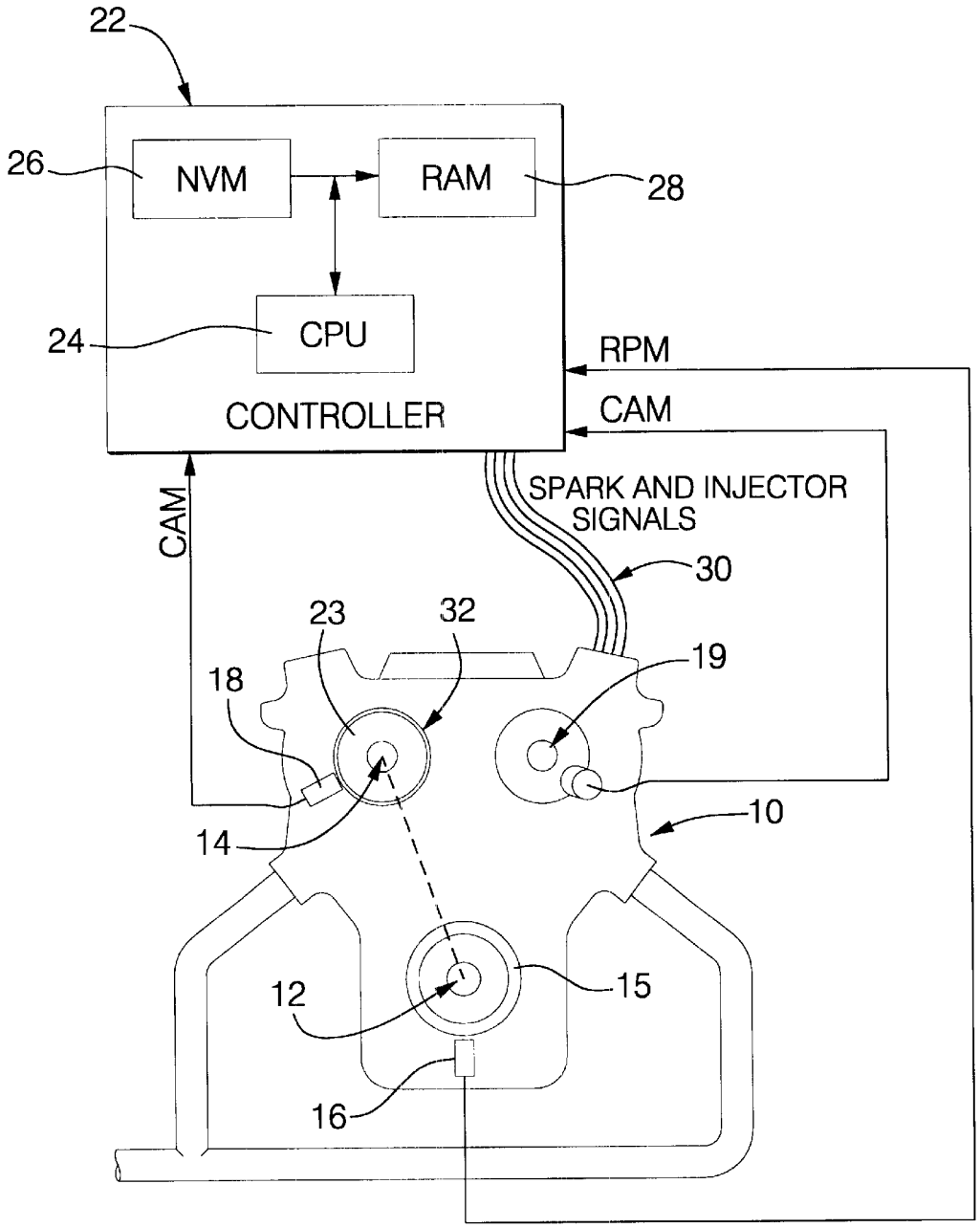
FIG. 1 is a diagrammatic drawing of the engine and cam sensing system of the present invention.
Figure 2:
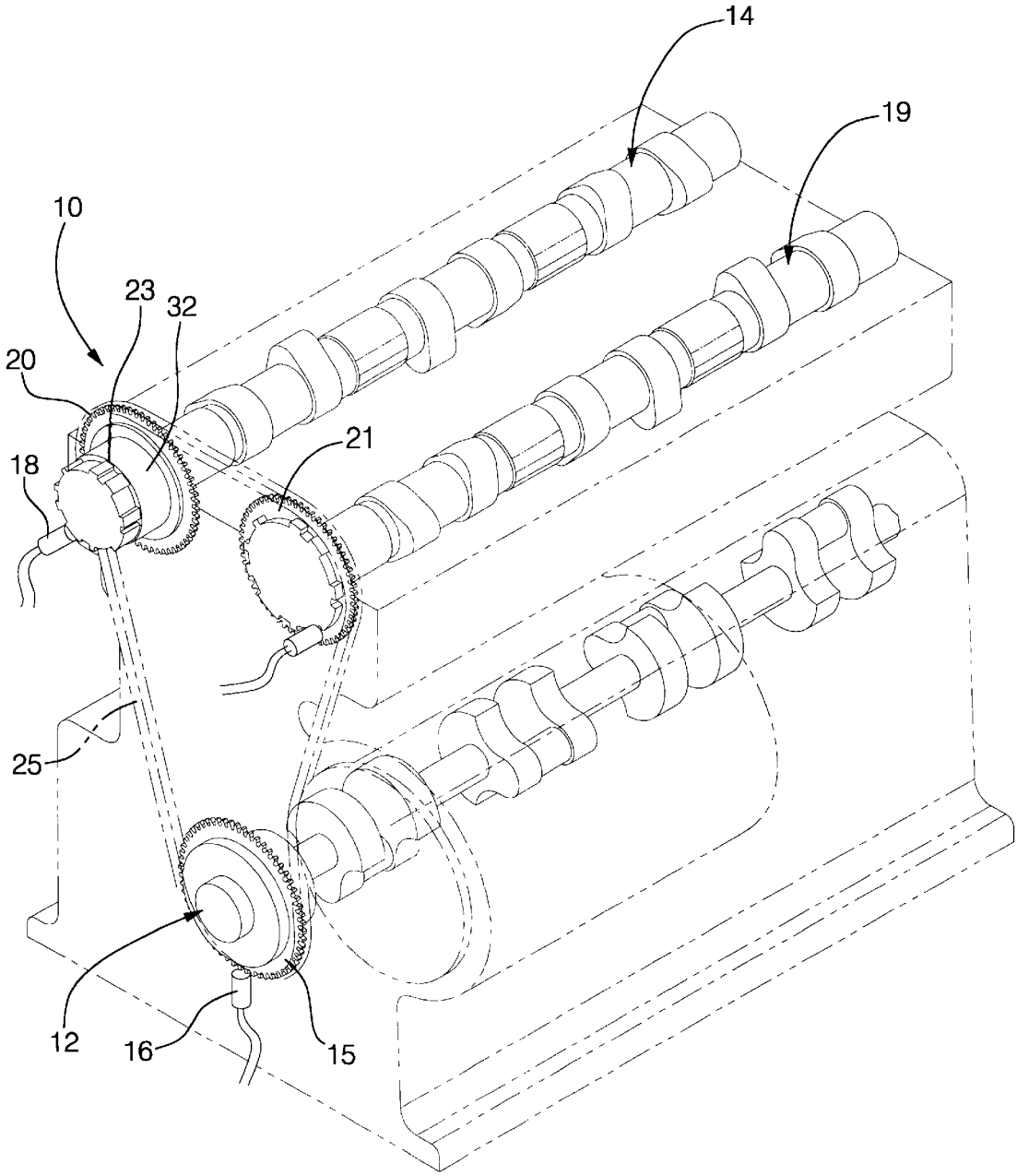
FIG. 2 is a perspective drawing of the engine used in the preferred embodiment of the present invention.

Referring to FIGS. 1 and 2, an internal combustion engine 10 having a crankshaft 12 communicates in the form of periodic signals generated by the rotation of a target wheel 15 on the crankshaft 12 by a conventional wheel speed sensor 16. The wheel speed sensor 16 may comprise any known wheel speed-sensing device including, but not limited to, variable reluctance sensors, Hall effect sensors, optical switches and proximity switches. The purpose of the wheel speed sensor 16 is to detect the teeth on the target wheel 15 and provide a pulse train to an electronic controller 22. The electronic controller 22, in conjunction with other sensors, will determine the speed and position of the crankshaft 12 using the periodic signals generated by the speed sensor 16.

The vehicle controller 22 may be any known microprocessor or controller used in the art of engine control. In the preferred embodiment, the controller 22 is a microprocessor, having nonvolatile memory NVM 26 such as ROM, EEPROM or flash memory, random access memory RAM 28, and a central processing unit (CPU) 24. The CPU 24 executes a series of programs to read, condition and store inputs from vehicle sensors. The controller 22 uses various sensor inputs to control the application of fuel and spark to each cylinder through conventional spark and fuel injector signals 30. The controller 22 further includes calibration constants and software stored in NVM 26 that may be applied to control numerous engine types.

In the preferred embodiment of the present invention, as shown in FIG. 2, an inline six-cylinder engine is shown with exhaust camshaft 14 and intake camshaft 19. The exhaust camshaft 14 and intake camshaft 19 are coupled to the crankshaft 12 via sprockets 20 and 21 and a timing chain 25. The exhaust camshaft 14 actuates exhaust valves for the cylinders, and the intake camshaft 19 actuates intake valves for the cylinders, as is commonly known in the art. A target wheel 23 coupled to the exhaust camshaft 14 generates periodic signals using wheel position sensor 18 to provide speed and position information for the exhaust camshaft 14. The wheel position sensor 18 may be similar in functionality to wheel speed sensor 16.

The present invention may further be equipped with a continuously variable cam phaser 32, as is known in the art. The cam phaser 32 in the preferred embodiment may be coupled to the exhaust camshaft 14. In alternate embodiments of the present invention, a cam phaser 32 may be coupled to the intake camshaft 19 or to both the exhaust and intake camshafts 14, 19, depending on the desired performance and emission requirements of the ICE 10. The cam phaser 32 is hydraulically modulated to create a variable rotational offset between the exhaust camshaft 14 and the intake camshaft 19 and/or the crankshaft 12. The degrees of rotational offset generated by the cam phaser 32 enables the ICE 10 to be tuned for specific performance requirements by varying valve overlap, i.e., overlap between the exhaust and intake valves of the ICE 10. In applications where it is required that NOx components are reduced, the cam phaser 32 can provide charge dilution in the form of recirculated exhaust gases. Charge dilution is a method of adding an inert substance to the air/fuel mixture in a cylinder of the ICE 10. The inert substance will increase the heat capacity of the air/fuel mixture and reduce the amount of NOx components created during combustion. Thus, by regulating the valve overlap area, NOx components may also be regulated. Furthermore, engine performance characteristics such as horsepower and fuel economy may also be modified using the cam phaser.

Figure 3:
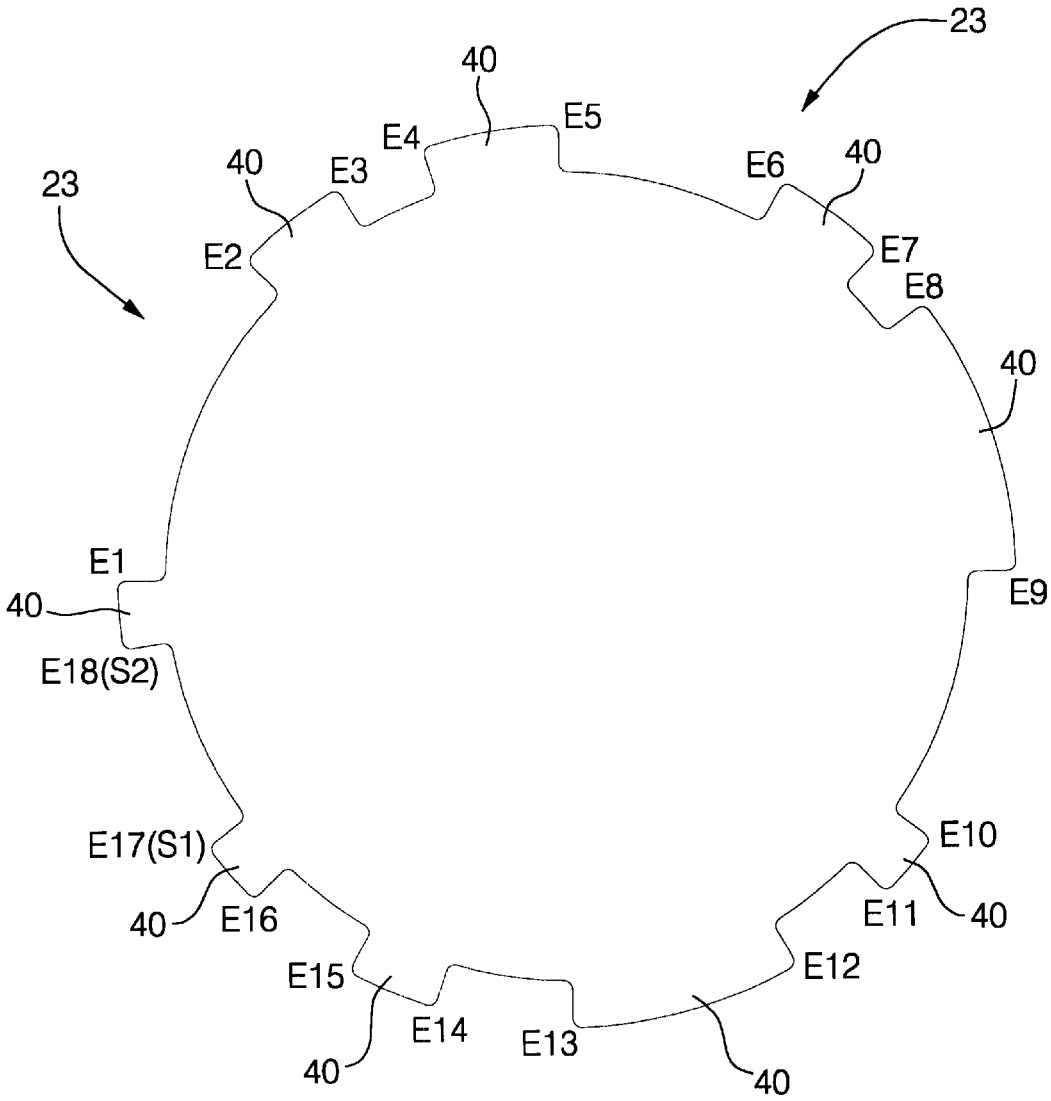
FIG. 3 is a diagram of the preferred embodiment of a target wheel used in the present invention.

FIG. 3 is a diagram of the target wheel 23 of the preferred embodiment of the present invention that will be described in conjunction with a timing diagram of FIG. 4. The target wheel 23 includes an irregular surface having teeth, slots or tabs 40. The teeth 40 have edges E1–E18 for generating a pulse train for wheel position sensor 18. Referring to FIGS. 4A–4C, a timing diagram is shown with a series of exhaust, intake and ignition events 50, a pulse train 52 generated by the target wheel 15 and target wheel sensor 16, and a pulse train 54 generated by the target wheel 23 and target wheel position sensor 18. The pulse train 54 includes edges E1–E18 that correspond to the physical layout of the teeth 40 on target wheel 23. The edges E1–E18 signal the controller 22, the position and speed of the exhaust camshaft 14 and the state of the crankshaft 12 (i.e., is it in the compression or exhaust phase) and corresponding cylinders to allow the application of spark and fuel by the controller 22.

Figures 4, 4A:
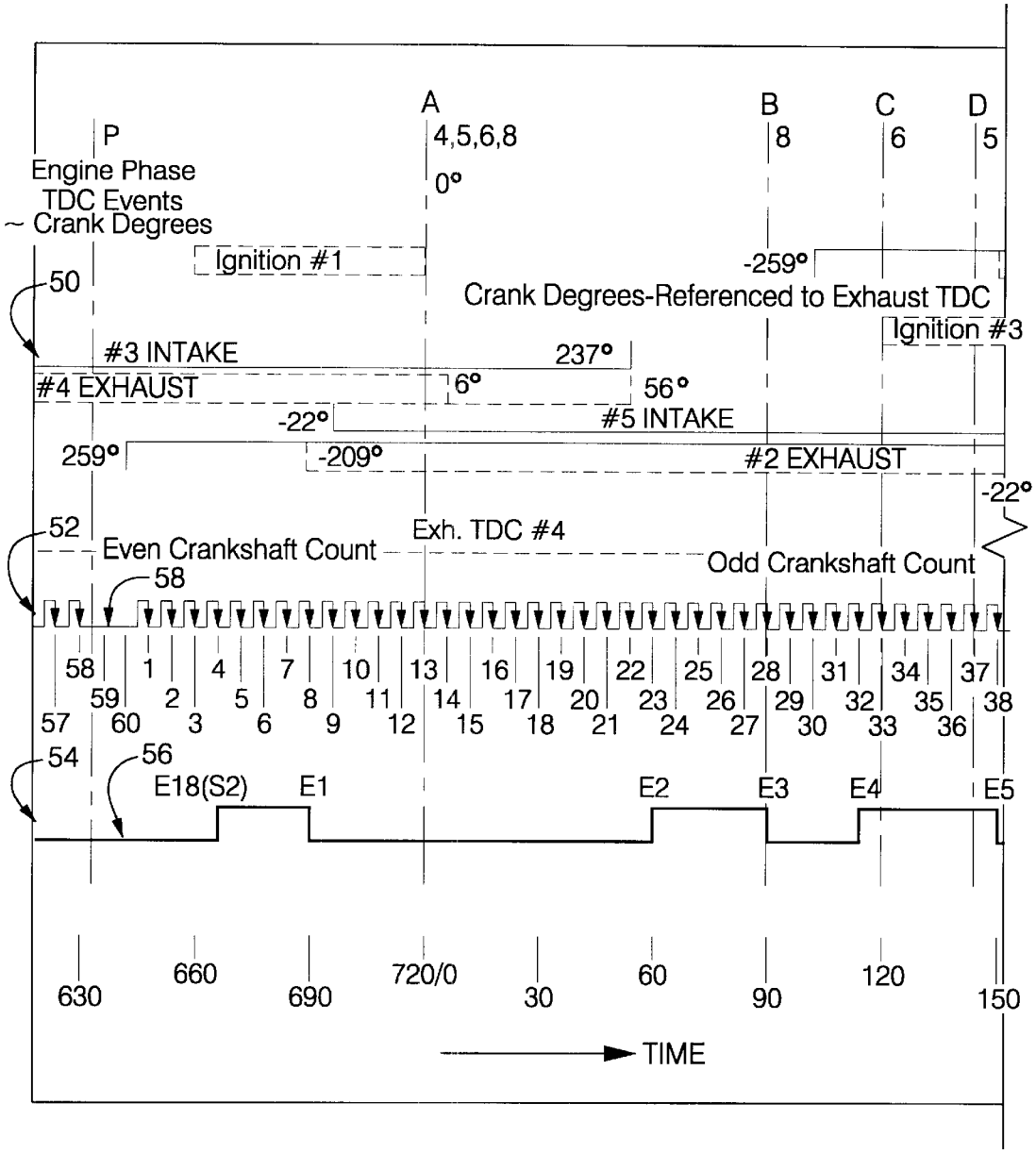
FIG. 4 is a timing diagram illustrating the signals generated by the target wheel of the present invention.
Figure 4B:
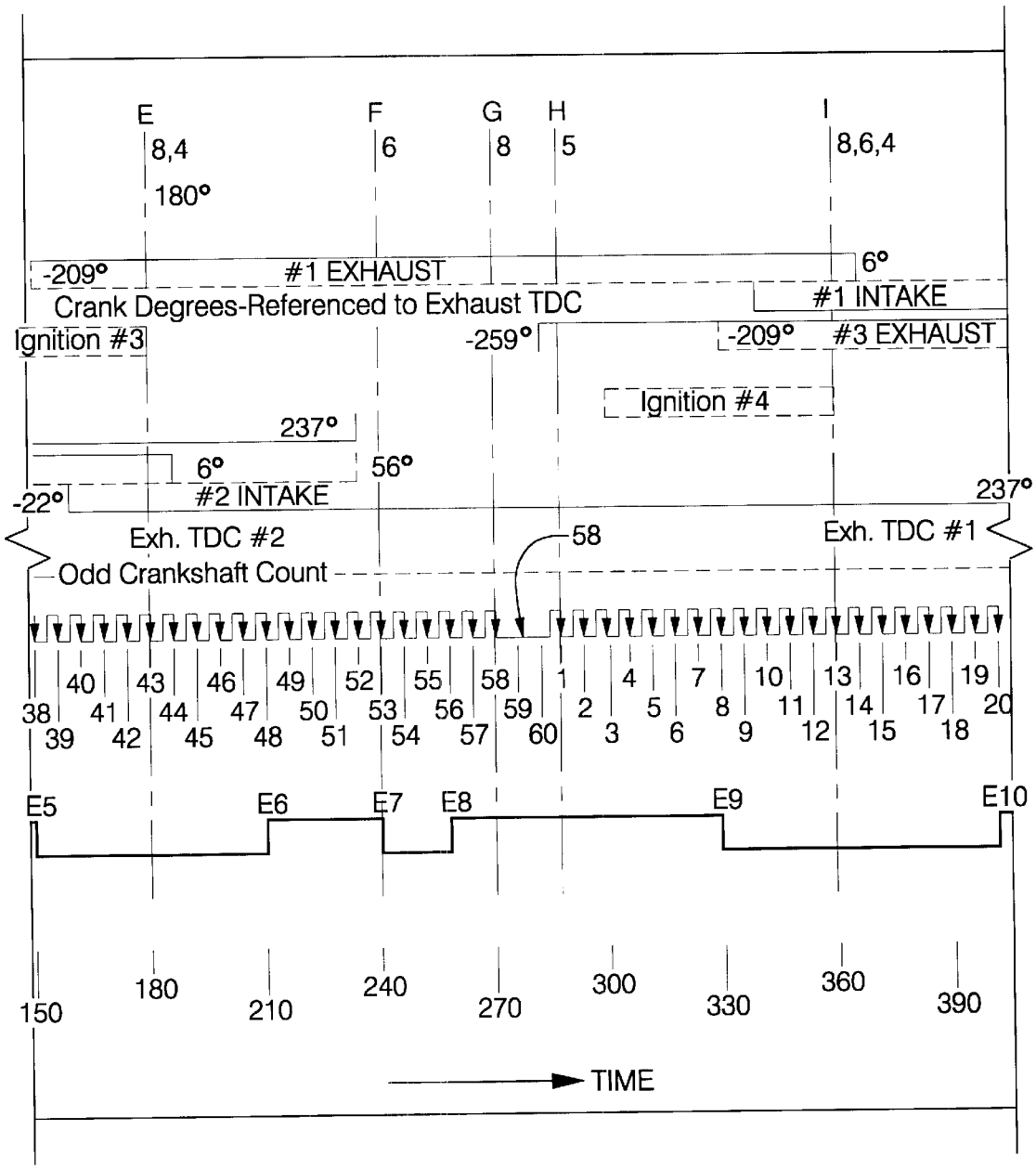
Figure 4C:
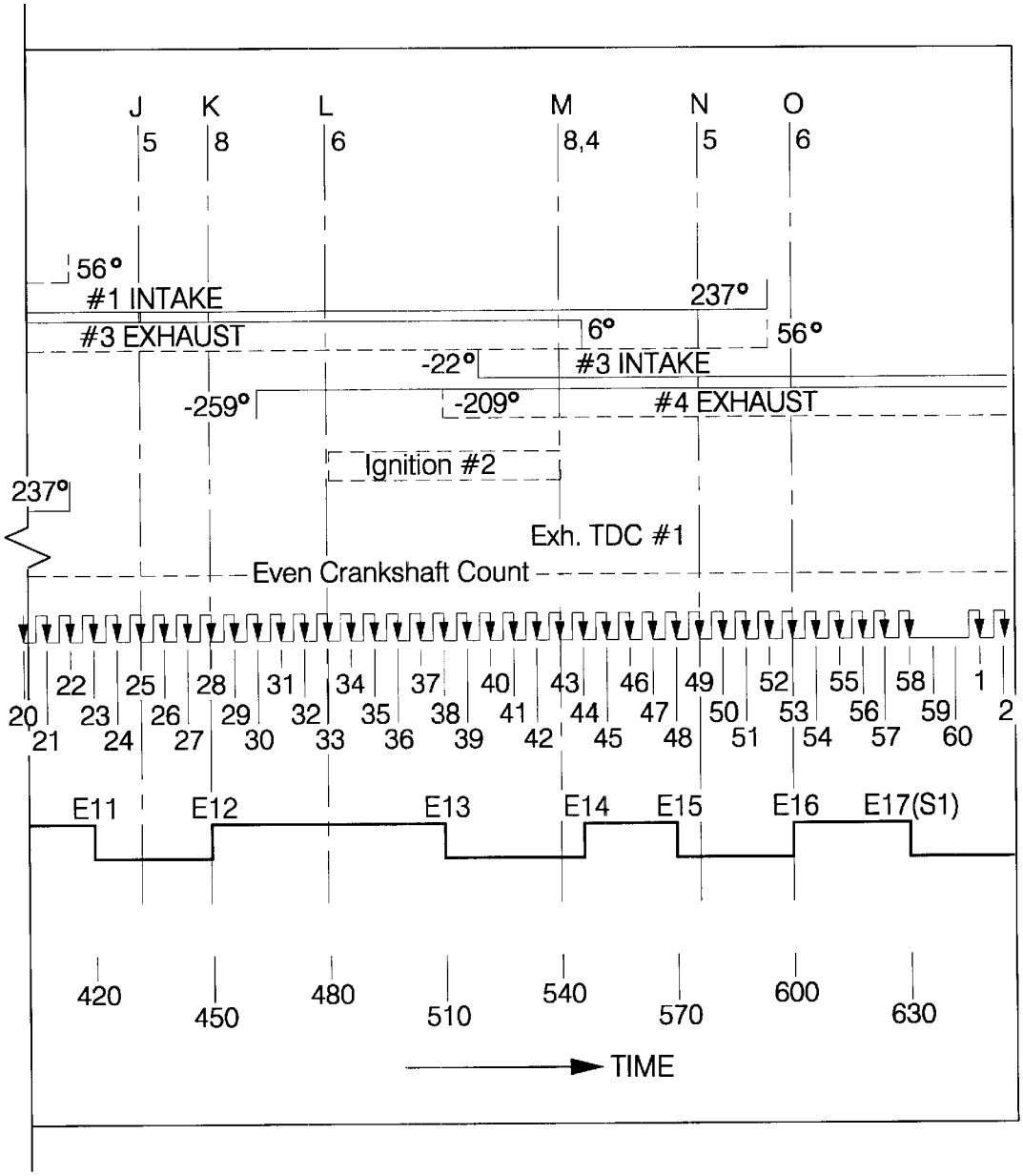

Lines A–P in FIGS. 4A–4C correspond to the top dead center (TDC) position in time for the various engine configurations that may be used with the target wheel 23 of the present invention such as four, five, six and eight cylinder engines. Referring to FIGS. 4A–4C, line A indicates the TDC position for cylinder one of a four, five, six and eight cylinder engine. Line B indicates the TDC position for cylinder two of an eight-cylinder engine, Line C indicates the TDC position for cylinder two of a six-cylinder engine. Line D indicates the TDC position for cylinder two of a five-cylinder engine. Line E indicates the TDC position for cylinder three of an eight-cylinder engine and cylinder two of a four-cylinder engine. Line F indicates the TDC position for cylinder three of a six-cylinder engine. Line G indicates the TDC position for cylinder four of an eight-cylinder engine. Line H indicates the TDC position for cylinder three of a five-cylinder engine. Line I indicates the TDC position for cylinder five of an eight-cylinder engine, cylinder four of a six-cylinder engine and cylinder three of a four-cylinder engine. Line J indicates the TDC position for cylinder four of a five-cylinder engine. Line K indicates the TDC position for cylinder six of an eight-cylinder engine. Line L indicates the TDC position for cylinder five of a six-cylinder engine. Line M indicates the TDC position for cylinder seven of an eight-cylinder engine and cylinder four of a four-cylinder engine. Line N indicates the TDC position for cylinder five of a five-cylinder engine. Line 0 indicates the TDC position for cylinder six of a six-cylinder engine. Line P indicates the TDC position for cylinder eight of an eight-cylinder engine.

As can be seen in the timing diagram of FIG. 4, lines A–P generally correspond in time to the edges E1–E16 of the pulse train 54 generated by the target wheel 23. A synchronization pulse 58 generated by the crankshaft 12 signals the control system to read the state of the cam sensor 18 input. This is generally done when the camshaft is in its rest position. The state will be low if the cam sensor 18 is in the sync region (between E17 and E18) or high if the camshaft is between edges E8 and E9. A synchronization pulse 56 generated by edges E17 and E18 of target wheel 23 enables the control system to instantly determine if cylinder one is in a compression or exhaust state.

The target wheel 23 of the present invention may be used on a plurality of engines having multiple cylinder configurations. This aids in manufacturing and assembly of an engine since only one control system will need to be produced as opposed to multiple control systems. A vehicle equipped with a specific engine configuration need only be calibrated to reference the edges E1–E16 that correspond to the specific engine configuration. In the preferred embodiment of the present invention, the electronic controller 22 contains software in NVM 26 to operate any type of engine configuration and a flag is set to signal the controller 22 what type of engine it will be controlling.

The control system of the present invention further provides cam phase measurement to provide feedback to the controller 22 as it modulates the cam phaser 26. The target wheel 23 and associated position sensor 18 also provides a redundant engine signal to determine if the crank speed sensor 16 is performing correctly. If the crank speed sensor 16 has failed, the position sensor 18 will provide engine speed and position information to the controller 22, enabling the controller 22 to schedule fuel and spark in the event of the loss of the crank sensor. The cam phaser measurement and the application of fuel and spark may be used by the present invention for any ICE configuration by using the edges E1–E16 that are specified in software for a particular engine configuration.

While this invention has been described in terms of some specific embodiments, it will be appreciated that other forms can readily be adapted by one skilled in the art. Accordingly, the scope of this invention is to be considered limited only by the following claims.

What is claimed is:

1. A target wheel for providing timing information for a camshaft in an internal combustion engine, the target wheel comprising a substantially circular member having an irregular surface coupled to the camshaft, said irregular surface capable of providing camshaft position and speed information for a plurality of different internal combustion engine configurations.

2. The target wheel of claim 1 wherein said plurality of different internal combustion engine configurations are selected from the group comprising, four-cylinder engines, five-cylinder engines, six-cylinder engines, or eight-cylinder engines.

3. The target wheel of claim 1 wherein said irregular surface comprises a plurality of protruding tabs.

4. The target wheel of claim 3 wherein at least one of said protruding tabs differs in dimensions from at least a second protruding tab.

5. The target wheel of claim 4 wherein said at least one of said protruding tabs differs in width from said at least second protruding tab.

6. A camshaft system for use with an internal combustion engine comprising:

a camshaft having a plurality of lobes to actuate valves in the internal combustion engine;

a sprocket coupled to said camshaft to drive said camshaft; and a target wheel coupled to said camshaft, said target wheel having an irregular radial surface;

said irregular radial surface comprising a plurality of tabs providing engine timing information for a plurality of engine configurations such that the camshaft system may be operated with a plurality of engine configurations.

7. The camshaft system of claim 6 further comprising a cam phaser coupling said camshaft to said sprocket.

8. The camshaft system of claim 6 further comprising a sensor sensing said radial irregular surface to provide an electrical output.

9. The camshaft system of claim 8 further comprising an electronic controller coupled to said sensor to interpret said electrical output to determine speed and position of said camshaft.

10. The camshaft system of claim 9 wherein said electronic controller includes engine control software that is adaptable to said plurality of engine configurations by using selected pulses in said pulse string.

11. The camshaft of claim 8, wherein said electrical output comprises a pulse string corresponding to said radial irregular surface.

12. The camshaft system of claim 11 wherein said engine configurations are selected from the group comprising four-cylinder engines, five-cylinder engines, six-cylinder engines, or eight-cylinder engines.

13. A method of adapting a camshaft control system to a plurality of engine configurations comprising the steps of:

providing a target wheel with tabs protruding from a radial surface of the target wheel;

configuring said tabs to provide engine timing information for a plurality of engine configurations;

mounting said target wheel to a camshaft;

providing a sensor to detect said tabs; and electronically coupling said sensor to an engine controller, said controller including calibration software to determine the timing of said tabs with respect to the operation of a particular engine configuration.

14. An internal combustion engine control system comprising:

an intake manifold for providing air to the internal combustion engine;

a throttle plate controlling the flow of said air;

a fuel injector introducing fuel into said air to form an air-fuel mixture;

at least one piston for combusting said air-fuel mixture using a spark plug;

a plurality of valves to control intake and exhaust of said at least one piston;

a first camshaft having a plurality of lobes to actuate said exhaust valves;

a sprocket coupled to said first camshaft to drive said first camshaft;

a crankshaft to drive said sprocket;

a target wheel coupled to said camshaft, said target wheel having an irregular radial surface capable of providing process data for operation of a plurality of internal combustion engine configurations; and said irregular radial surface comprising sixteen teeth, said sixteen teeth providing said process data for said plurality of internal combustion engine configurations.

15. The internal combustion engine of claim 14 wherein the internal combustion engine is a four-cycle engine.

16. The internal combustion engine of claim 14 wherein the internal combustion engine is a direct injection engine.

17. The internal combustion engine of claim 14 further comprising a second camshaft, said second camshaft controlling intake valves.

18. The internal combustion engine of claim 17 further comprising a cam phaser coupled to at least one of said first or second camshafts.

19. The internal combustion engine of claim 14 further comprising a sensor sensing said radial irregular surface to provide an electrical output.

20. The internal combustion engine of claim 14 further comprising an electronic controller coupled to said sensor to interpret said electrical output to determine speed and position of said camshaft.

21. The internal combustion engine of claim 20 wherein said electrical output comprises a pulse string corresponding to said irregular surface.

22. The internal combustion engine of claim 20 wherein said target wheel is capable of providing engine speed to be used for the application of fuel and spark by said controller.

23. The internal combustion engine of claim 14 wherein said electronic controller includes engine control software that is adaptable to a plurality of engine configurations using selected pulses in said pulse string.

24. The internal combustion engine of claim 14 wherein said target wheel is capable of determining if an engine crank speed sensor has failed.

* * * * *